US006508243B1

(12) United States Patent
Long

(10) Patent No.: US 6,508,243 B1
(45) Date of Patent: Jan. 21, 2003

(54) APPARATUS AND METHOD FOR PRACTICING HITTING A BASEBALL

(76) Inventor: Thomas L. Long, 6243 N. Casa Blanca, Paradise Valley, AZ (US) 85253

( * ) Notice: Subject to any disclaimer, the term of this patent is extended or adjusted under 35 U.S.C. 154(b) by 0 days.

(21) Appl. No.: 09/918,313

(22) Filed: Jul. 30, 2001

(51) Int. Cl.[7] ..... F41B 4/00

(52) U.S. Cl. ..... 124/1; 124/6; 124/78

(58) Field of Search ..... 124/1, 6, 78, 80; 473/451

(56) References Cited

U.S. PATENT DOCUMENTS

| | | | | |
|---|---|---|---|---|
| 4,559,918 A | * | 12/1985 | Ballerin et al. | 124/78 |
| 6,082,350 A | * | 7/2000 | Crews et al. | 124/78 |
| 6,305,366 B1 | * | 10/2001 | Rizzo et al. | 124/6 |
| 6,415,782 B1 | * | 7/2002 | Holland | 124/78 |

* cited by examiner

*Primary Examiner*—John A. Ricci
(74) *Attorney, Agent, or Firm*—Tod R. Nissle, P.C.

(57) ABSTRACT

Pitching apparatus delivers a sequence of different kinds of pitches to a batter and prevents a batter from ascertaining from the position of the pitching apparatus the kind of pitch which the apparatus will deliver.

3 Claims, 2 Drawing Sheets

APPARATUS AND METHOD FOR PRACTICING HITTING A BASEBALL

This invention relates to games in which a ball is hit with a bat, racket, paddle, club or other instrument for striking the ball or other spherically shaped object.

More particularly, the invention relates to a method and apparatus for practicing hitting a ball or other spherically shaped object with a selected striking instrument.

In a further respect, the invention relates to apparatus of the type described including a pitching machine in which the orientation of the machine is altered when the type of pitch being delivered by the machine is altered.

In another respect, the invention relates to apparatus which includes a pitching machine of the type described and which prevents a batter from ascertaining when the orientation of the pitching machine is altered to alter the type of pitch delivered by the machine.

Pitching machines are well known in the art. In use, a pitching machine is charged with a ball. The machine engages the ball and "throws" or ejects the ball through the air toward a batter. The batter attempts to hit the ball. One well known pitching machine is the HITTING STREAK® manufactured by American Training Equipment Co. Of 10 Greg Street, Sparks, Nev. 89431. The various components of pitching machines which are necessary to engage a ball and to propel the ball through the air toward a hitter are well known in the art and are not detailed herein.

Many pitching machines, especially machines designed to throw balls to simulate pitches thrown by major league professional pitchers, can deliver to a batter a ball along a path through the air which simulates at least two different pitches, for example, a fastball and a curve ball. When the kind (or speed) of pitch simulated by a pitching machine is varied, for instance from a fastball to a slider, the orientation of the pitching machine ordinarily is altered. For example, the HITTING STREAK® machine is placed in one orientation on a fixed tri-pod to deliver a fastball, and is placed in a second orientation of the fixed tri-pod to deliver a curveball or off-speed pitch. Regardless of whether the HITTING STREAK® is delivering a fastball or offspeed pitch, the position of the fixed tri-pod remains the same, while only the position of the HITTING STREAK® on the tri-pod is altered. A batter quickly learns from the position and orientation of the HITTING STREAK® on the tripod to deduce the kind of pitch which will be delivered by the pitching machine. The ability of a hitter to determine the type of pitch being simulated by a pitching machine is in some instances not desirable. It often is preferred that the batter not be able to determine ahead of time the type of pitch delivered by a pitching machine. Even though this problem has long existed, there does not appear to be available any pitching machines which do not, based on the orientation of the machine, indicate the type of pitch being simulated by the machine.

Accordingly, it would be highly desirable to provide an improved pitching apparatus which could simulate a variety of different pitches without enabling a batter to determine from the orientation of the machine the kind of pitch being delivered.

It would also be highly desirable to provide an improved pitching machine of the type described which could, when the type of pitch being simulated is known to the batter, deliver in quick succession from the same point multiple throws of the same or multiple type(s) of pitch(es).

Therefore, it is a principal object of the machine to provide an improved apparatus and method for producing and simulating a variety of different pitches utilized in baseball or another sport which utilizes a ball or other spherically shaped object.

A further object of the invention is to provide an improved method and apparatus of the type described which prevents a batter from determining from the orientation of the pitching apparatus utilized the kind of pitch being delivered and simulated by the apparatus.

Another object of the invention is to provide an improved method and apparatus of the type described which can delivery a sequence of different kinds of pitches to a batter.

Still another object of the invention is to provide an improved method and apparatus of the type described which can deliver a rapid sequence of pitches each originating and traveling toward a batter from the same delivery point.

Yet a further object of the invention is to provide an improved method and apparatus of the type described which can deliver pitches over selected different areas of home plate or other target.

These and other, further and more specific objects and advantages of the invention will be apparent to those skilled in the art from the following detailed description thereof, taken in conjunction with the drawings, in which.

Figure 1:
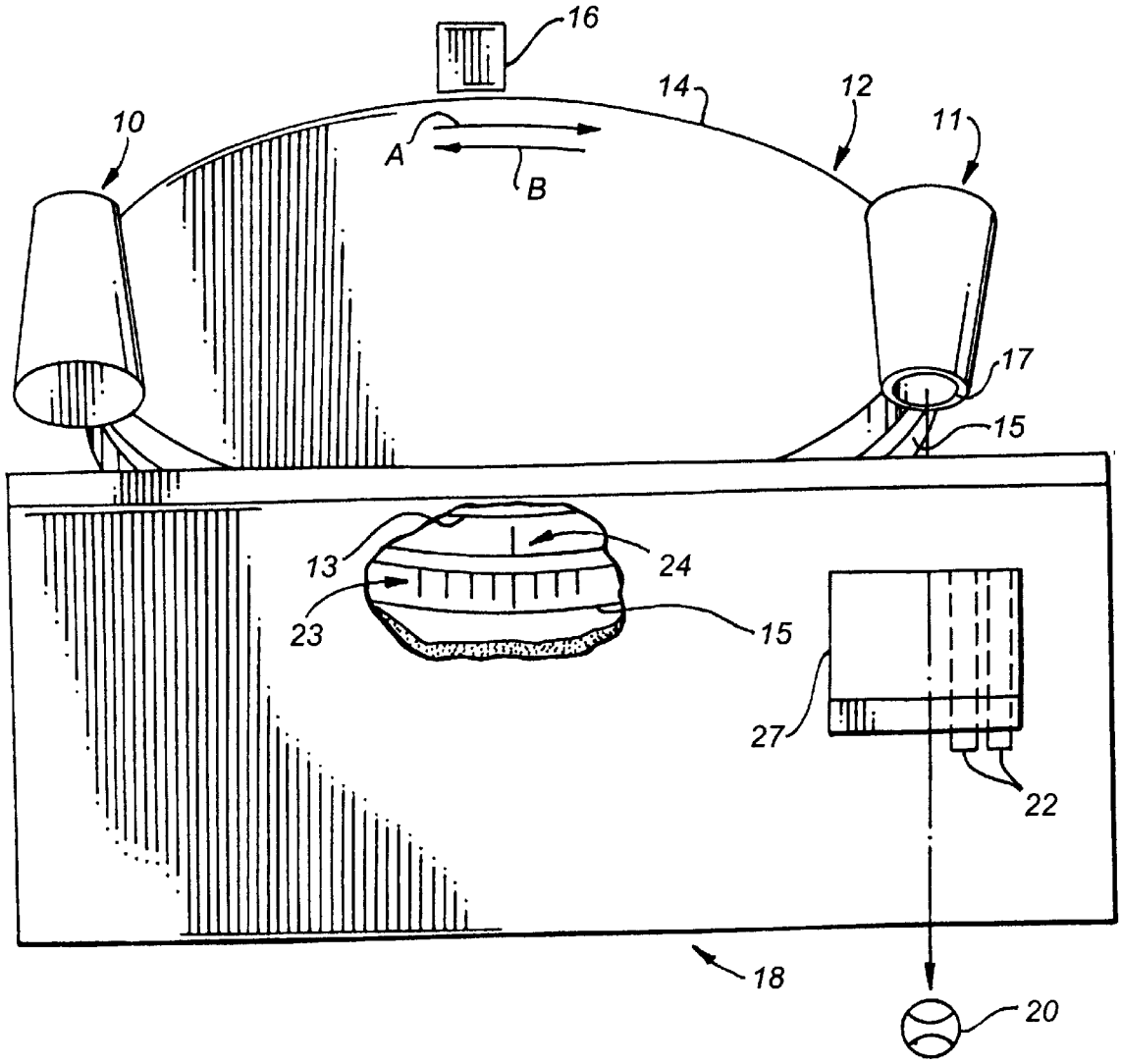
FIG. 1 illustrates pitching apparatus constructed in accordance with the principles of the invention.

Briefly, in accordance with my invention, I provide an improved pitching apparatus for simulating and delivering a plurality of different pitches. The pitching apparatus includes a plurality of pitching machines. Each pitching machine includes apparatus for engaging and propelling a ball through the air to simulate at least a first kind of pitch and a second kind of pitch. Each pitching machine is movable between at least two operative positions, a first operative position for delivering the first kind of pitch, and, a second operative position for delivering the second kind of pitch. The pitching apparatus also includes mounting apparatus for the pitching machines to move each of the pitching machines between a first delivery position from which a ball is propelled from the pitching machine through the air, a second standby position different than said first delivery position. The pitching apparatus also includes apparatus for obscuring each of the pitching machines when the pitching machine is in the first delivery position such that a batter is unable to discern the orientation of the pitching machine in the first delivery position.

In accordance with another embodiment of my invention, I provide improved pitching apparatus. The apparatus includes a plurality of pitching machines. Each pitching machine includes apparatus for engaging and propelling a ball through the air. The pitching apparatus also includes mounting apparatus for the pitching machines to move each of the pitching machines between a first delivery position from which a ball is propelled from the pitching machine through the air, and, a second standby position different than the first delivery position. The pitching apparatus also includes apparatus for obscuring each of the pitching machines when the pitching machine is in the first delivery position such that a batter is unable to discern the orientation of the pitching machine in the first delivery position.

In a further embodiment of the invention, I provide a method for propelling a ball through the air for a batter to hit. The method includes the step of providing a plurality of pitching machines. Each pitching machine includes apparatus for engaging and propelling a ball through the air. One of the pitching machines is operable to deliver a first kind of pitch. Another of the pitching machines is operable to deliver a second kind of pitch. The method also includes the step of mounting each of the pitching machines on the mounting apparatus to move each of the pitching machines between a first delivery position from which a ball is propelled from the pitching machine through the air, and a second standby position different than the first delivery position. The method also includes the step of providing obscuring means for positioning to obscure each of the pitching machines when the pitching machine is in the first delivery position such that a batter is unable to discern the orientation of the pitching machine in the first delivery position. The method also includes the steps of positioning the obscuring means to obscure each of the pitching machines when the pitching machine is in the first delivery position; moving one of the pitching machines to the first delivery position; operating the pitching machine to deliver the first kind of pitch to the batter; moving an other of the pitching machines to the first delivery position; and, operating the other pitching machine to deliver the second kind of pitch to the batter.

In still another embodiment of my invention, I provide an improved pitching apparatus for simulating and delivering a plurality of different pitches. The pitching apparatus includes a plurality of pitching machines. Each pitching machine includes apparatus for engaging and propelling a ball through the air to simulate at least a first kind of pitch and a second kind of pitch. The pitching apparatus also includes mounting apparatus for the pitching machines to move each of the pitching machines between a first delivery position from which a ball is propelled from the pitching machine through the air, a second standby position different than said first delivery position. This embodiment of the invention is useful in the event a pitching machine is available or is developed which permits the type of pitch being delivered by the machine to be changed without altering the outward appearance and/or orientation of the pitching machine.

Turning now to the drawings, which depict the presently preferred embodiments of the invention for purposes of illustrating the invention and not by way of limitation of the scope of the invention, and in which like reference characters refer to corresponding elements throughout the several views, FIG. 1 illustrates pitching apparatus constructed in age accordance with the principles of the invention and including a plurality of pitching machines 10, 11 fixedly attached to a mounting apparatus 12 including a daisy wheel or carousel. The daisy wheel includes an upper circular horizontally oriented panel member 13 having a circular peripheral edge 14. Member 13 is rotatably mounted on a lower fixed circular horizontally oriented panel support member 15. Member 13 can be rotated on fixed support member 15 in the directions indicated by arrows A and B. Support member 15 is fixedly attached to four spaced apart legs 36, 37 of equal shape and dimension. Three or more pitching machines 10, 11 can, if desired, be mounted on member 13.

A clutch or other brake mechanism 16 is fixedly secured to member 15. When the clutch is disengage from the outer peripheral edge 14 of member 13, member 13 can freely rotate in either direction A or B. Member 13 can be rotated manually, with a motor mounted on the apparatus, or by any other desired means. After member 13 is rotated to a desired position, the clutch 16 engages the peripheral edge 14 of member 13 to prevent member 13 from rotating. Any desired means can be utilized in place of or in combination with clutch mechanism 16 to move member 13 to a selected position and secure member 13 is a selected fixed position. By way of example and not limitation, the peripheral edge 14 of member 13 can be provided with teeth in the manner of a ratchet wheel and mechanism 16 can be provided with a pawl which permits member 13 to turn in one direction on support member 15. This pawl-ratchet construction generally prevents member 13 from rotating in one of directions A and B. Once member 13 is turned to a selected position, it can be secured by any desired means. The peripheral edge 14 or other desired portion of member 13 can be provided with one or more indicium 24. The peripheral edge or other desired portion of member 15 can similarly be provided with one or more indicium 23. The indicia can be positioned on member 13 and 15 such that selected ones of the indicia are in alignment when a pitching machine 11 is at a desired location behind aperture 27 to deliver a ball through aperture 27 and through the air along a path toward a batter 21. Such an alignment of indicia can also, when the indicia are sufficiently closely spaced together, enables an individual utilizing the apparatus to turn member 13 only through a short arc of, for example, one-quarter to one inch (depending on the diameter of member 13), in order to move a machine 11 laterally a short distance so that a pitch delivered by machine 11 can vary laterally from side to side over the inside to the outside part of home plate or other target (when the hitter 21 is practicing hitting a baseball).

The orientation of the mounting apparatus can vary as desired. For example, members 13 and 15 need not be horizontally oriented but can be vertically oriented or otherwise canted.

Figure 2:
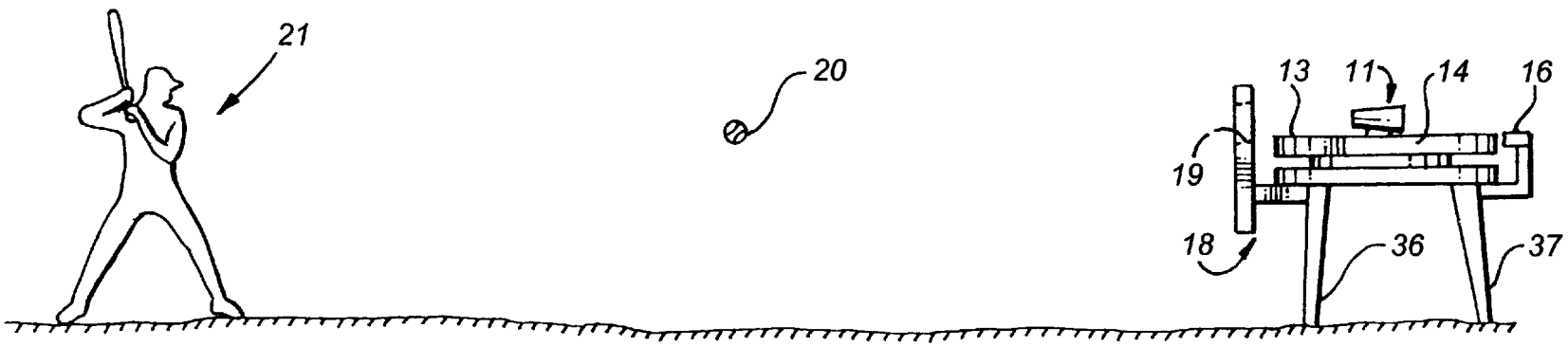
FIG. 2 is a side view illustrating the mode of operation of the apparatus of FIG. 1.

Pitching machines 10 and 11 are identical, although this need not be the case. Each machine 10, 11 includes mechanisms for engaging and propelling a ball through the air to simulate at least a first kind of pitch (i.e., a fastball) and a second kind of pitch (i.e., a curve ball, change-up, slider, etc.). Machines 10, 11 can each also alter the speed at which a pitch is propelled from the machine 10, 11 through the air. Each machine engages and propels a ball 20 out through circular opening 17 and into the air along a path toward a batter 21 who is practicing hitting a baseball or other spherically shaped object. The mechanisms in each machine 10, 11 necessary to engage and propel a ball 20 along a path through the air toward a batter 21 are well known in the art and shall not be detailed herein. When the kind of pitch or the speed of a pitch delivered by a machine 10, 11 is altered, the elevation or other orientation of a machine 10, 11 may need to be altered. Consequently, even though each machine 10, 11 is attached to member 13, the position of each machine 10, 11 with respect to member 13 (and member 15) can be altered, in the same manner that the position of a HITTING STREAK® machine can be altered when the machine is mounted on a tripod or on a fixed horizontally oriented rail or pipe. One way of allowing the position of a machine 10, 11 to be adjusted is to mount pivotally the machine 10, 11 on a U-shaped bracket. The U-shaped bracket is fixedly attached to member 13. Since, however, machine 10, 11 is pivotally secured between the upstanding legs of the U-shaped bracket, the machine can be pivoted to alter the orientation or position of the machine with respect to the bracket and member 13. Any desired means can be utilized to adjustably mount a machine 10, 11 on member 13. Any desired mounting apparatus can be utilized in conjunction with or in place of the mounting apparatus 12 illustrated in FIGS. 1 and 2. Each machine 10, 11 can also be adjusted to alter the speed of a particular kind of pitch delivered by the machine. When the kind of pitch delivered by a machine 10, 11 is altered, the machine is normally moved vertically to insure that the pitch delivered by the machine will pass through aperture 27 at the same or nearly the same elevation as other kinds of pitches delivered by the machine.

Obscuring apparatus 18 is fixedly secured to member 15 and includes square aperture 27 formed therethrough. A curtain comprised of strips of fabric 22 is attached to the upper edge of aperture 27 to prevent a batter 21 from being able to see through aperture 27 and view a pitching machine 10, 11 positioned behind apparatus 18. Any desired means other than fabric strips 22 can be utilized to prevent a batter from viewing a machine 11 which propels a ball 20 through aperture 27 and through the air along a path toward baiter 21. Apparatus 18 obscures from the view of a batter a machine which is, like machine 11 in FIG. 1, in position to deliver a pitch through aperture 27 to a batter. Apparatus 18 also preferably, but not necessarily, obscures from the view of a batter 21 a pitching machine which is, like machine 10 in FIG. 1, in a standby position and is not ready to deliver a pitch through aperture 27 toward a batter 21.

The shape and dimension of aperture 27 can vary as desired. Aperture 27 is preferably large enough to permit a ball 20 or other spherically shaped object propelled by a machine 11 to pass through aperture 27 when a variety of different speed and kinds of pitches are delivered by a machine 11 positioned behind the obscuring apparatus 18. Apparatus 18 also preferably obscures member 13 so a batter can not see or hear when member 13 is being moved. More than one aperture 27 can be formed in apparatus 18 and the location of aperture(s) 27 in apparatus 18 can vary as desired. For example, one aperture 27 can be utilized to simulate pitches from a pitcher who throws in a normal overhand motion. Another aperture 27 can be utilized to simulate pitches from a pitcher with a side arm delivery. If two or more apertures are formed in apparatus 18, it may also be desirable to utilize two or more mounting apparatus 12, i.e., to use a separate mounting apparatus 12 for each aperture 27.

In use, a pitching machine 11 is adjusted or set up to throw one kind of pitch, for example, a fastball. Machine 10 is set up or positioned to throw a different kind of pitch, for example a curve ball. While machines 10 and 11 can be set up or positioned to throw the same kind of pitch, it is preferred to set them up to each produce a different kind of pitch so that a hitting coach or other person operating the apparatus of FIG. 1 during batting practice can better simulate what a pitcher does during an actual game.

The batter 21 takes his position (FIG. 2) and waits for a machine 11 to deliver a pitch. The coach or other person operating the apparatus of FIGS. 1 and 2 can vary the time elapsed before the coach activates machine 11 to cause machine 11 to propel a ball 20 through the air toward batter 21. After machine 11 delivers a pitch (i.e., a fastball) to batter 21, the coach can deliver the same pitch once more by activating machine 11, or, the coach can release clutch 16 from engagement with member 13 and turn, or cause to be turned, member 13 so that machine 10 is in the "delivery" position of machine 11 in FIG. 1 and so that machine 11 assumes the standby position occupied by machine 10 in FIG. 1. Once machine 10 is in the delivery position, the coach operates clutch 16 to engage edge 14 and prevent member 13 from turning. The coach then activates machine 10 to deliver a different pitch (i.e., a curve ball) to the batter 21. One of the principal virtues of the apparatus of the invention is that a batter can not visually determine the kind of pitch he will be receiving because the batter 21 can not see the orientation of machines 10, 11 or of member 13. This allows the apparatus to much more closely simulate the conditions a batter 21 will encounter during an actual game against a human pitcher.

In one embodiment of the invention, pitching machines 10, 11 are each set or adjusted to deliver to a batter 21 a pitch which is different than the pitch delivered by the other pitching machine(s). Movement of member 13 and the operation of machines 10, 11 to deliver a pitch is controlled by a computer. A sequence of two or more pitches is programmed into the computer. The sequence of pitches utilizes one or more of the pitching machines 10, 11. In many instances, the sequence of pitches will utilize two or more pitching machines 10, 11 mounted on member 13 so that while receiving the sequence of pitches a batter 21 will encounter a series of pitches which includes two or more different kinds of pitches. After the sequence of pitches is programmed into the computer, the computer causes the sequence of pitches to be delivered to batter 21 by controlling the movement of member 13 and activating each machine 10, 11 to deliver a pitch when the machine is in the delivery position occupied by machine 11 in FIG. 1. The computer can also be programmed to vary the time between pitches to better simulate actual conditions encountered by a batter 21 during an actual game against a human pitcher.

Rotatable member 13 is presently preferred in the practice of the invention because it represents a simple method of moving each machine 10, 11 between a delivery position (the position of machine 11 in FIG. 1) where the machine can propel a ball through aperture 27 toward a batter and a standby position (the position of machine 10 in FIG. 1) where the machine can not propel a ball through aperture 27. As would be appreciated by those of skill in the art, mounting apparatus other than member 13 can be utilized to move each machine 10, 11 between a standby position and a delivery position. By way of example, and not limitation, members 13 and 15 and legs 36,37 can be eliminated and a long horizontally oriented tube or pole can be positioned behind apparatus 18. Each machine 10, 11 is slidably mounted on the pole. When one machine is slid along the pole to a delivery position immediately behind aperture 27, the other machine is slid along the pole to a standby position which is behind apparatus 18. The machine in the delivery position can project a ball 20 through aperture 27 and through the air toward batter 21 in the manner indicated in FIGS. 1 and 2. The machine in the standby position can not project a ball through aperture 27. After the machine in the delivery position is slid along the pole away from the delivery position to a standby position behind apparatus 18, the other machine is slid along the pole from its standby position to a delivery position behind aperture 27 to deliver a ball through aperture 27 toward a batter 21.

While it is possible to deliver balls through two or more apertures 27 formed in the apparatus 18, it is presently preferred that each pitch delivered to batter 21 originate from the same area, i.e., come out of a single aperture 27 toward the batter.

Having described my invention in such terms as to enable those skilled in the art to understand and practice it, and having identified the presently preferred embodiments thereof,

I claim:

1. Pitching apparatus for simulating a plurality of different pitches, said apparatus including (a) a plurality of pitching machines, each including means for engaging and propelling a ball through the air to simulate at least a first kind of pitch and a second kind of pitch, each of said pitching machines being adjustable between at least two operative positions, (i) a first operative position for delivering said first kind of pitch, and, (ii) a second operative position for delivering said second kind of pitch; and, (b) mounting means including a common base for said pitching machines to move each of said pitching machines between (i) a first delivery position from which a ball is propelled from the pitching machine through the air, each of said pitching machines occupying a selected space on said base when in said first delivery position, (ii) a second standby position different than said first delivery position, each of said machines when moved to said second standby position being moved on said base completely out of said selected space such that another of said machines can be moved into and occupy said selected space; and, (c) means for obscuring each of said pitching machines when said pitching machine is in said first delivery position such that a batter is unable to discern the orientation of said pitching machine in said first delivery position.

2. Pitching apparatus including (a) a plurality of pitching machines, each including means for engaging and propelling a ball through the air; and, (b) mounting means including a common base for said pitching machines to move each of said pitching machines between (i) a first delivery position from which a ball is propelled from the pitching machine through the air, each of said pitching machines occupying a selected space on said base when in said first delivery position, (ii) a second standby position different than said first delivery position, each of said machines when moved on said base to said second standby position being moved completely out of said selected space such that another of said machines can occupy said selected space; and, (c) means for obscuring each of said pitching machines when said pitching machines are in said first delivery position such that a batter is unable to discern the orientation of said pitching machine in said first delivery position.

3. A method for propelling a ball through the air for a batter to hit, including the steps of (a) providing a plurality of pitching machines each including means for engaging and propelling a ball through the air, one of said pitching machines being operable to deliver a first kind of pitch and another of said pitching machines being operable to deliver a second kind of pitch; and, (b) mounting each of said pitching machines on mounting means to move each of said pitching machines on a common base between (i) a first delivery position from which a ball is propelled from the pitching machine through the air, each of said pitching machines occupying a selected space on said base when in said first delivery position, and (ii) a second standby position different than said first delivery position, each of said machines when moved on said base to said second standby position being moved completely out of said selected space such that another of said machines can occupy said selected space;

(c) providing obscuring means for positioning to obscure each of said pitching machines when said pitching machine is said first delivery position such that a baiter is unable to discern the orientation of said pitching machine in said first delivery position;

(d) positioning said obscuring means to obscure each of said pitching machines when said pitching machine is in said first delivery position;

(e) moving said one of said pitching machines to said first delivery position and into said selected space;

(f) operating said one of said pitching machines to deliver said first kind of pitch to the batter;

(g) moving said one of said pitching machines out of said selected space;

(h) moving another of said pitching machines to said first delivery position and into said selected space; and, (i) operating said another of said pitching machines to deliver said second kind of pitch to the baiter.

* * * * *